United States Patent [19]

Lehman

[11] Patent Number: 4,518,895

[45] Date of Patent: May 21, 1985

[54] MECHANISM AND METHOD FOR CONTROLLING THE TEMPERATURE AND OUTPUT OF A FLUORESCENT LAMP

[75] Inventor: Richard F. Lehman, Fairport, N.Y.

[73] Assignee: Xerox Corporation, Stamford, Conn.

[21] Appl. No.: 478,749

[22] Filed: Mar. 25, 1983

[51] Int. Cl.[3] ..... H01J 7/24; H01J 13/32; H01J 17/28; H01J 19/74; H01J 61/52

[52] U.S. Cl. ..... 315/117; 315/112; 313/11; 313/44

[58] Field of Search ..... 315/112, 113, 114, 115, 315/116, 117, 118; 313/11, 44

[56] References Cited

U.S. PATENT DOCUMENTS

| | | | |
|---|---|---|---|
| 1,908,648 | 5/1933 | Spaeth | 315/108 |
| 3,309,565 | 3/1967 | Clark et al. | 315/117 |
| 3,686,529 | 8/1972 | Boland | 315/115 |
| 4,001,633 | 1/1977 | Van Tongersen et al. | 315/117 |
| 4,005,332 | 1/1977 | Gallo et al. | 315/112 |
| 4,101,807 | 7/1978 | Hill | 315/116 |
| 4,101,809 | 7/1978 | Hill | 315/117 |
| 4,146,819 | 3/1979 | Hunter | 315/117 |
| 4,283,658 | 8/1981 | Parker | 315/117 |
| 4,431,947 | 2/1984 | Ferriss et al. | 315/117 |

*Primary Examiner*—Saxfield Chatmon

[57] ABSTRACT

The temperature of a fluorescent lamp is optimized by monitoring the current used to power the lamp and changing the cooling state (on to off, off to on) whenever lamp current increases. The optimum current level is some minimum value; any increases in this value are detected and a signal is fed back to a controller which regulates the instant mode of operation of a cooling device. With the cooling mode reversed, the lamp current will be reduced towards its optimum value. The cooling mode remains unaltered until the lamp current rises again. Thus the optimum temperature (minimum current to produce the required light level) is achieved without reference to either an absolute current or temperature.

2 Claims, 4 Drawing Figures

MECHANISM AND METHOD FOR CONTROLLING THE TEMPERATURE AND OUTPUT OF A FLUORESCENT LAMP

BACKGROUND

This invention relates to mercury vapor fluorescent lamps and particularly to a method for maintaining the mercury pressure within the lamp at an optimum value by monitoring the current in an optical feedback power supply and regulating the operation of a lamp cooling device in response to current changes.

In a mercury fluorescent lamp, an electrical discharge is generated in mercury vapor at low pressure and typically mixed with argon gas. The light output from the lamp depends, among other variables, on the mercury vapor pressure inside the lamp tube. The primary radiation from the mercury is at 2537 Angstroms and arises from the transition between the lowest nonmetastable excited state and the ground state. This ultraviolet radiation at 2537 Angstroms excites a phosphor which is coated inside the tube walls. The excited phosphor thereupon emits radiation at some wavelength, in the visible spectrum, characteristic of the phosphor.

It is known in the prior art that the optimum mercury pressure for maximum light output of a fluorescent lamp in alternating current operation is approximately 7 mtorr (independent of current) which corresponds to a mercury cold spot temperature of approximately 42° C. At this temperature and pressure, the light output increases monotonically with the current. At cold spot temperatures higher or lower than the optimum, light output falls off.

It is therefore desirable to maintain the mercury pressure at the optimum for any lamp current and at any ambient temperature. Prior art techniques for accomplishing this function required a temperature-sensitive device such as a thermocouple, thermistor or thermostat to monitor the temperature of the cold spot. A feedback circuit provided closed loop control of a temperature-regulating device to maintain the optimum mercury pressure. These methods, although providing a closed loop control of the cold spot temperature, require calibration for each lamp and must rely on a consistent relationship of cold spot temperature to light ouput which may not exist under all conditions.

In copending application Ser. No. 478,746, filed on Mar. 25, 1983 and assigned to the same assignee as the present invention a control method is disclosed which includes an optical detector which senses the visible emission from a fluorescent lamp and generates a signal to change the state of the temperature regulating device. This control method is used in combination with a constant current power supply; e.g. the lamp current is kept constant throughout operation. This technique cannot be used with an optical feedback power supply in which current can vary from very high initial turn-on currents to a minimum current which occurs at optimum lamp operating temperature. In copending application Ser. No. 478,745, filed on Mar. 25, 1983, also assigned to the same assignee as the present invention, another control method is disclosed in which a monitoring circuit detects changes in the lamp arc voltage and generates signals to change the state of the temperature-regulating device. This method can be used with a constant current or an optical feedback power supply. In the case of the optical feedback power supply usage however, there exists a tendency for the voltage sensing circuit to get out of phase on a cyclical basis resulting in less than optimum performance.

The present invention is directed to a novel mechanism and method for maintaining optimum mercury lamp pressure in conjunction with use of a feedback power supply. The mechanism includes a monitoring device for sensing lamp current levels. As will be described in the succeeding descriptive portion of the specification the lamp current is in phase with the light emission of the lamp as a function of temperature. According to one aspect of the invention when a minimum lamp current is established (corresponding to optimum cold spot temperature), any changes in lamp current are detected and used to change the state of the cold spot temperature-regulating device. The lamp current is the continually monitored by a circuit which is adapted to feed back a signal to a cold spot temperature-regulating device under certain conditions. The circuit responds to an increase in the lamp current by reversing the operating mode of the temperature-regulating device. Thus, if the device has been off it is turned on and if on, it is turned off. Either action has the effect of restoring the lamp current to its minimum (optimum) level, and hence restoring the optimum mercury pressure.

A prime advantage of the method of the invention is that once the distribution and feedback circuit are designed with the appropriate algorithm, the system does not require any absolute calibration; that is, the minimum lamp current for a particular lamp does not need to be determined. Further, the feedback circuit is extremely fast relative to the prior art feedback loop which required a longer response time due to the thermal mass of the mercury pool heat sink, the glass envelope and the temperature sensitive device.

The present invention is therefore directed to a control circuit for optimizing and controlling the light output of a fluorescent lamp containing an excess of mercury at a cold spot therein, said circuit comprising:

a feedback power supply for applying operating current to said lamp, said operating current corresponding to a minimum current level associated with an optimum cold spot temperature;

temperature control means adapted to operate in a first mode whereby temperature at said cold spot is increasing and in a second mode whereby temperature at said cold spot is decreasing, and a monitoring means for detecting an increase in the optimum lamp current, said monitoring means adapted to transmit a signal to said temperature control means changing the instant mode of operation upon detection of said current increase.

DRAWINGS

DESCRIPTION

Figure 1:
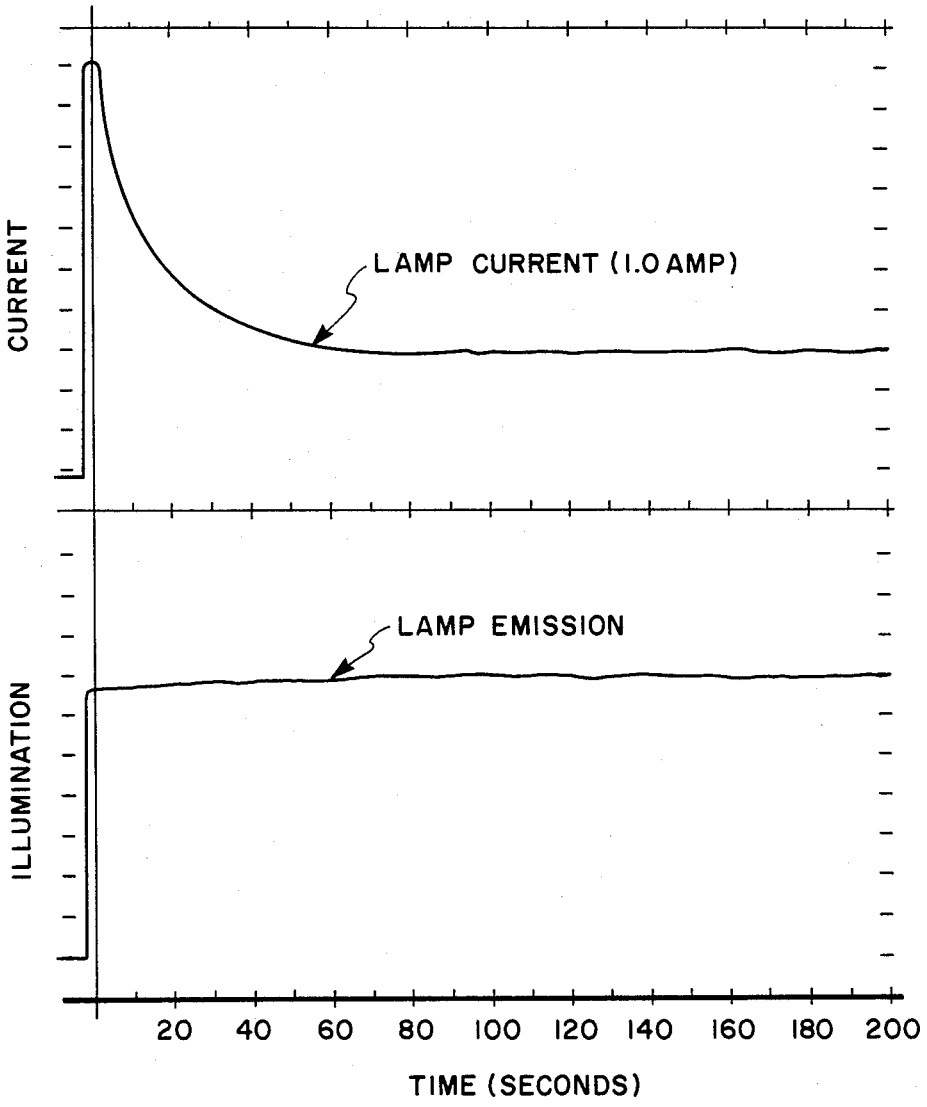
FIG. 1 is a graph plotting lamp current and emission over a time period immediately following cold start turnon.

Referring to FIG. 1 there is shown a graph depicting lamp current conditions and lamp emission conditions during a period of time following lamp turn on. The graph was prepared using a T8,22 inch fluorescent lamp. The lamp was started from a cold state and, about 80 seconds after turn on has reached a steady (minimum) value of about 1 amp which coincides with the light output peak of the lamp. This light output peak can be measured by an optical detector while monitoring the instantaneous current level. The lamp current has been observed to be in phase with the light output; therefore, by maintaining the lamp current at the optimum level, the light emission remains very constant.

Figure 2:
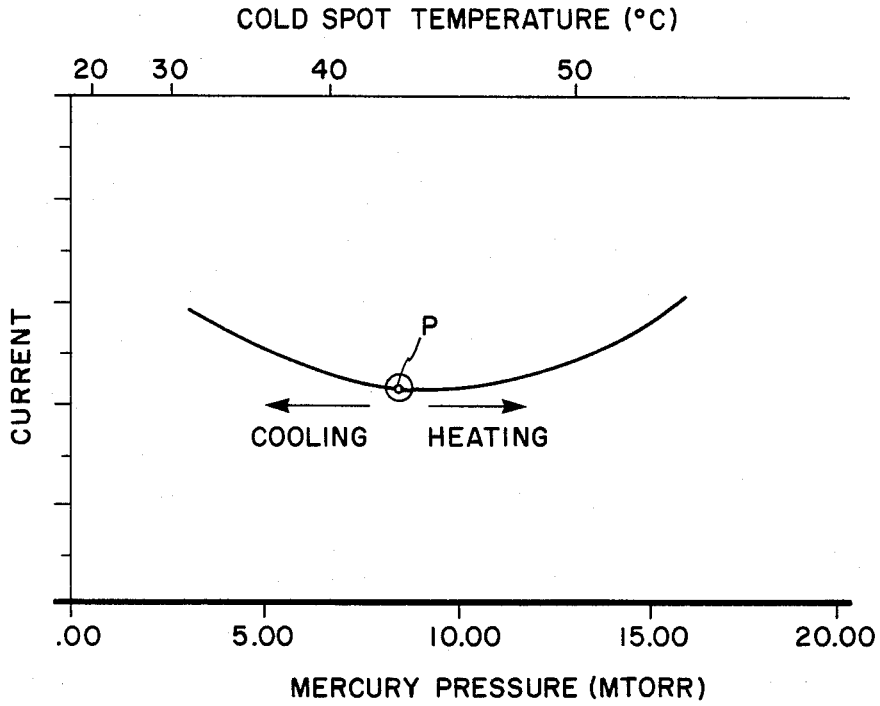
FIG. 2 is a graph plotting fluorescent lamp operating current against mercury cold spot temperature and pressure.

FIG. 2 is a graph illustrating the relation between lamp current, mercury pressure and mercury cold spot temperature. As shown, there is a point P at which the current is the minimum value shown in FIG. 1. Point P corresponds to the optimum mercury pressure of 7 mtorr at 42° C. which in turn corresponds to the optimum operating efficiency of the lamp. The mercury vapor pressure, being dependent upon temperature, will vary above or below the optimum during lamp operation; depending on the temperature variation as affected by the instant mode of operation of the temperature regulating device (i.e. a cooling fan or thermoelectric device). As is evident in FIG. 2, the lamp current will move away from its peak point P with either a rise or a fall in the cold spot temperature. According to one aspect of the invention the current is monitored by a circuit which detects any change (increase) from the optimum minimum current. The circuit then generates a signal which reverses the operating mode of the particular temperature-regulating device resulting in a reversal of the particular direction of the temperature change and a restoration of the optimum current and hence, cold spot temperature. As an example, if a cooling fan is being used to direct a flow of air against the mercury cold spot, and if the fan is in the inoperative (off) position, the cold spot temperature will tend to rise above the optimum. The lamp current will then increase towards the right in the FIG. 2 plot. This increase will be detected by the monitoring circuit and a signal will be generated and sent to the fan, via a control circuit, reversing the previous operational mode; that is, the fan will be turned on. The effect of the cooling will tend to decrease the cold spot temperature and return the pressure, current and light output to their optimum levels. If the system establishes equilibrium at the optimum operating point, the monitoring circuit remains inactive. If however, the temperature again drops below the optimum, the circuit again detects an increase in the optimum current and generates a signal to again reverse operation of the fan. In this case the fan will be turned off, allowing the temperature to rise towards the optimum. It does not matter in which direction the current is increasing since the output signal to the temperature regulating means will always have the effect of selecting the operating mode appropriate to a restoration of the optimum operating level.

The above described technique requies the generation of a single algorithm to differentiate as to the conditions where the lamp current is above optimum but is moving back towards the optimum (function is improving) as opposed to the condition where the current is above the optimum and is increasing (function not improving). Using the example of a fan directing air against the cold spot, if the current is decreasing in magnitude and the fan is off, the algorithm will be able to recognize that the lamp has not yet reached peak temperature and the fan should therefore remain off. The algorithm only responds to *increases* in the lamp current. If however, the current was increasing and the fan was off, the algorithm will recognize that the fan needed to be turned on to lower the temperature. The algorithm must also incorporate time delays that allow the lamp a chance to respond to the new cooling change. An example of a suitable algorithm is provided below.

Figure 3:
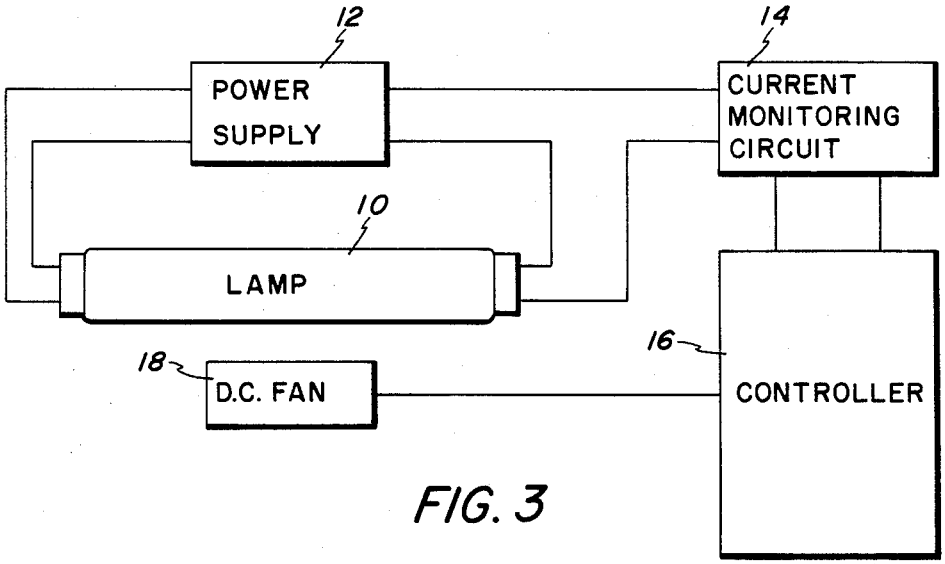
FIG. 3 is a schematic diagram of a circuit including a current monitoring circuit and a controller which implement the output control techniques of the present invention.
Figure 4:
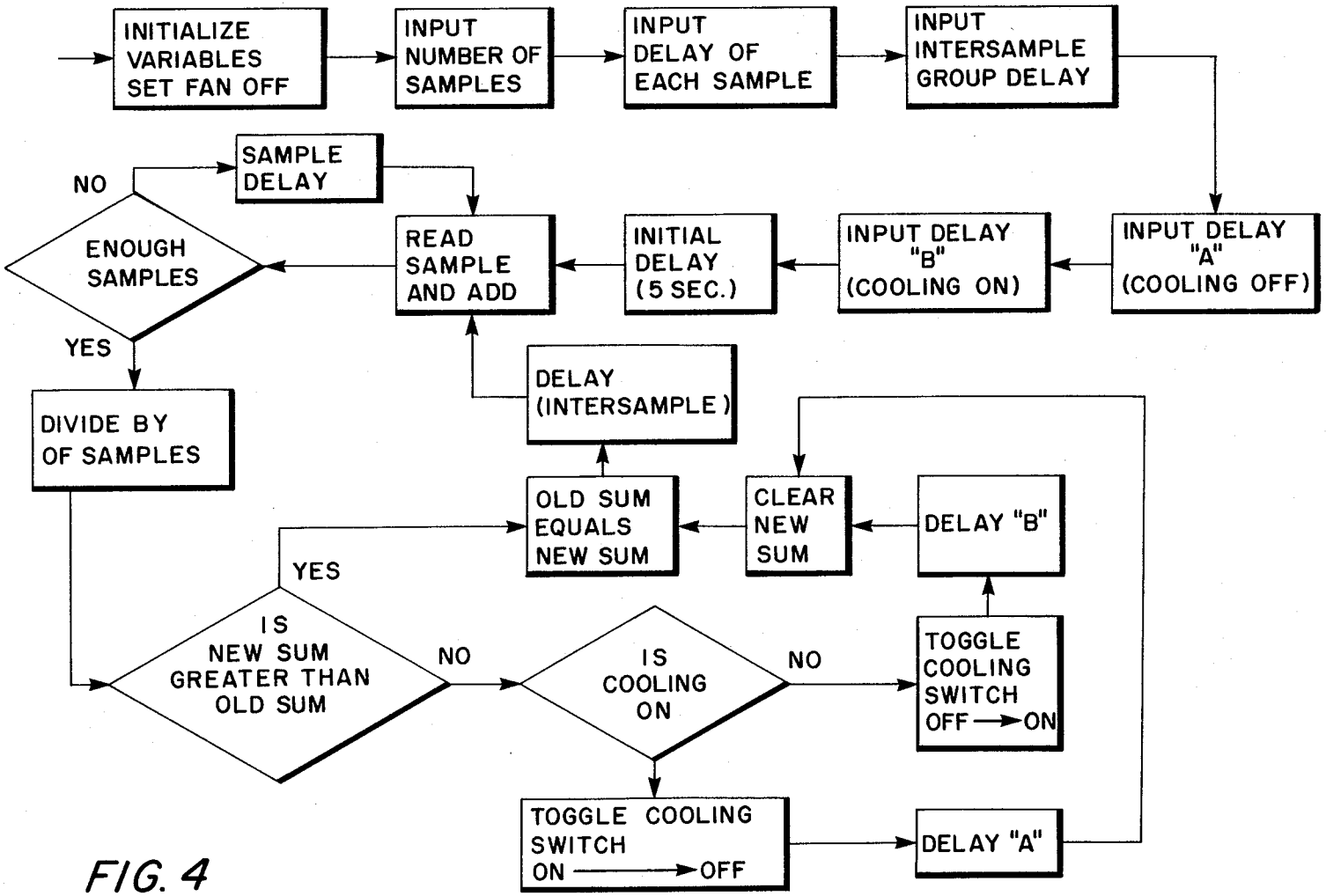
FIG. 4 is a program plan diagram of the controller shown in FIG. 3.

FIG. 3 is a block diagram of a circuit set-up to implement the monitoring technique broadly disclosed in the above discussion. Lamp 10 is a T8, 22" fluorescent lamp operated at 1.2 amps with a high frequency (29 Khz) optical feedback power supply 12. A current monitoring circuit 14, monitors the lamp current and generates a signal sent to controller 16. Fan 18 is placed near the center of the lamp and about 4" away to provide mercury cold spot cooling when it is turned on. Controller 18 is a microprocessor based controller which receives current sensing information from circuit 14. The controller is programmed to control the operation of fan 12 so as to maintain cold spot temperature and pressure at optimum. FIG. 4 is the algorithm flow diagram for this program. As shown in FIG. 4, the algorithm contains the following variables: number of samples, time between individual samples, time between groups of samples and two delay times, one for each mode switch. The algorithm compares the average value of a group of samples with the previous averaged group and if a higher than optimum current level has been detected, changes the cooling mode (on to off or off to on). Further sample taking is then delayed to allow lamp 10 to respond to the change. Two time delays A and B were found to be necessary since it was found that the lamp responded much faster to the application of the cooling airflow then when the airflow is stopped. A time delay of 5 secs for "A" and 1 sec for "B" provided satisfactory results.

The foregoing description of the methods and circuits of the present invention is given by way of illustration and not of limitation. Various other embodiments may be utilized to perform the monitoring and control functions while still within the purview of the invention. For example, instead of a cooling fan, a thermoelectric (Peltier's junction) cooler could be used to control the cold spot temperature in response to signals generated in the current monitoring circuit.

What is claimed is:

1. A monitoring and control mechanism for optimizing the light output of a fluorescent lamp containing an excess of mercury at a cold spot therein, said mechanism comprising:

a power supply for applying operating current to said lamp, said operating current at normal lamp operation corresponding to a minimum current level associated with an optimum cold spot temperature, a monitoring means for detecting an increase in lamp current and generating a signal indicative thereof, a temperature control device placed in proximity to said cold spot, said device, when operational, lowering the temperature of the cold spot and, when non-operational, effectively permitting the cold spot temperature to rise, and a controller circuit adapted to change the operational state of said temperature control device in response to the output signals from said monitoring means.

2. A method of optimizing the light output of a fluorescent lamp containing an excess of mercury at a cold spot thereon comprising the steps of determining the lamp current level corresponding to an optimum cold spot temperature and lamp light output, monitoring the current level of said lamp, modifying the temperature at said cold spot by means of a cooling device having an active (cooling) mode of operation and an inactive (inoperative) mode of operation, and generating an electrical signal responsive to an increase of monitored current level, causing the instant mode of operation of said cooling device to be changed in response to said current increase.

* * * * *